US008002582B2

(12) United States Patent
Fakhri et al.

(10) Patent No.: US 8,002,582 B2
(45) Date of Patent: Aug. 23, 2011

(54) END CONNECTOR FOR A SHIELDED CABLE

(75) Inventors: Abdallah Fakhri, Paris (FR); Frédéric Laval, Cergy (FR)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 12/734,015

(22) PCT Filed: Oct. 9, 2007

(86) PCT No.: PCT/IB2007/004194

§ 371 (c)(1),
(2), (4) Date: Apr. 5, 2010

(87) PCT Pub. No.: WO2009/047582

PCT Pub. Date: Apr. 16, 2009

(65) Prior Publication Data

US 2010/0221939 A1 Sep. 2, 2010

(51) Int. Cl.
*H01R 9/03* (2006.01)

(52) U.S. Cl. ..... 439/607.44; 439/153

(58) Field of Classification Search ..... 439/445, 439/353, 358, 607.44, 153
See application file for complete search history.

(56) References Cited

U.S. PATENT DOCUMENTS

| | | | | |
|---|---|---|---|---|
| 5,895,289 | A * | 4/1999 | Smith | 439/553 |
| 6,231,392 | B1 * | 5/2001 | van Woensel | 439/607.44 |
| 6,997,749 | B1 * | 2/2006 | Harubayashi | 439/607.45 |
| 7,270,562 | B1 * | 9/2007 | Trout et al. | 439/364 |
| 2005/0003699 | A1 | 1/2005 | Fukui et al. | |
| 2005/0032421 | A1 | 2/2005 | Yamane | |
| 2006/0099851 | A1 | 5/2006 | Duarte et al. | |

FOREIGN PATENT DOCUMENTS

| | | | |
|---|---|---|---|
| EP | 1 622 231 | A1 | 2/2006 |
| JP | 04-370675 | A | 12/1992 |
| JP | 08-171964 | A | 7/1996 |
| JP | 2002-033153 | A | 1/2002 |
| JP | 2003-282189 | A | 10/2003 |
| JP | 2003-308930 | A | 10/2003 |
| JP | 2003-317821 | A | 11/2003 |
| JP | 2006-024568 | A | 1/2006 |
| JP | 2006-286598 | A | 10/2006 |

OTHER PUBLICATIONS

International Search Report mailed on Jul. 3, 2008.

* cited by examiner

*Primary Examiner* — Briggitte R Hammond
(74) *Attorney, Agent, or Firm* — Rader, Fishman & Grauer PLLC

(57) ABSTRACT

End connector (20) for connecting a shielded cable (30) to an equipment (10) on which it is to be connected. The connector comprises a connector body (40) provided to receive the shielded end of said shielded cable, and an orientation component (70) having first fastening means (74) for the fastening thereof onto said connector body and guiding means (72A, 72B, 72C) to set the orientation of the cable at the connection thereof with the connector body. In this end connector, the orientation component (70) further comprises second fastening means (100) for the fastening thereof onto said equipment (10). Thanks to these second fastening means, a long-lasting connection is realized between the connector (20) and the equipment (10).

13 Claims, 8 Drawing Sheets

END CONNECTOR FOR A SHIELDED CABLE

TECHNICAL FIELD

The present invention concerns an end connector. More precisely, the present invention is directed to an end connector in a vehicle, mounted at an end of a shielded cable which binds an equipment, especially a lighting equipment such as a headlight, to an electronic card supplying power thereto.

BACKGROUND ART

In a vehicle, the area of the headlight is densely occupied by miscellaneous equipments, and the size of all the equipments has to be reduced as much as possible. Advantageously, it also reduces the weight of the components, and often their price. For these reasons, there is a permanent tendency toward downsizing, and accordingly the connector size, and more generally the volume occupied by the connection, have to be kept as small as possible.

It is therefore now expected of a connector to realize its connection function within a small volume, while having a high reliability over the whole lifetime of the vehicle.

In the prior art, such connectors are designed with a connector body which usually comprises a connector housing, supporting an electrically conductive shield. The connector housing is made of plastic, while the shield is a metallic part.

For the fastening of the connector on the equipment on which it is to be connected, fastening means can be provided on the connector. Among known fastening means are hooks or bumps, cooperating with corresponding portions of the connected equipment, having a shape designed to retain them, for example.

However, it has been observed in such connectors, that it is difficult to guarantee a long-lasting connection, or to guarantee the connection when the level of vibrations is high. Indeed, after the vehicle has been used for a couple of years, in the case of a car for instance, in some cases the connector may come off, the equipment being thereby disconnected.

A reason of this disconnection problem is that the connector housing is a plastic part. After a few years, the plastic material loses part of its resilience properties, the small portions such as pegs realizing the connection function wear off, and progressively, the risk of disconnection increases.

Another problem related with the connection of electrical equipments, is the emission of electro-magnetic radiations. This problem is particularly pregnant with modern lighting bulbs used in vehicles, for instance high intensity discharge lamps such as Xenon lamps. Such bulbs need to be powered by a current of relatively high intensity, under average voltage of around 40V.

For safety reasons, it is necessary to limit the radiations emitted or received by the cable and the connection between the electronic card and the bulb.

In order to reduce these radiations, a shielded cable has generally to be used, comprising a plurality of internal conductors in isolating sheath or braid.

Naturally, it is also expected that the connector should maintain the continuity of the shielding between the cable and the connected equipment (the headlight), preventing thereby the emission or reception of undesirable radiations at the connection between the cable and the equipment. That is why shielding means are provided in the connector.

Moreover, in order to further reduce the level of radiations emitted by the cable, it is always preferable to reduce the length thereof, which also reduces its cost.

Besides, to prevent vibrations or noise under the hood of the vehicle, and to prevent the cable from being on the way and disturbing during maintenance operations, the cable is usually guided on its route between the electronic card and the connected equipment.

This guiding often includes the cable orientation being set or imposed at the point of junction with the equipment, that is, at the connector. To impose the route of the cable, at least at its junction with the connector, an orientation component has been used, as disclosed by the European patent application EP1622231.

Thanks to this component, the direction of the cable at the junction with the connector is determined. The orientation is set to the most favourable direction in order to reduce the length of the cable, thereby minimizing the emitted radiations, the length, weight and cost of the cable.

Despite these advantages, this orientation component does not solve the problem of the unwanted disconnection of the connector body from the equipment.

Moreover, as the sole connector body realizes the mechanical connection between the cable and the equipment, it must comprise specialized fastening means in order to realize that function. Therefore, the complexity and size of the connector body are increased.

DISCLOSURE OF THE INVENTION

The purpose of the invention is therefore to provide an end connector for connecting a shielded cable to an equipment on which it is to be connected, comprising an orientation component and of which the mechanical connection to the equipment is secured so that the connector would not be subject to undesired disconnections.

More precisely, the connector comprises a connector body provided to receive the shielded end of said shielded cable, and an orientation component having first fastening means for the fastening thereof onto said connector body and cable guiding means to set the orientation of the cable at the connection thereof with the connector body.

The above-mentioned purpose is achieved thanks to the fact that the orientation component further comprises second fastening means for the fastening thereof onto said equipment.

Indeed, it has been observed that such an orientation component connected to the connector body with the first fastening means and to the equipment with the second fastening means, being therefore essentially a mechanical, resilient component, provides a highly reliable connection between the connector and the equipment.

The orientation component is therefore turned into an orientation and fastening component, dedicated to two mechanical functions, firstly retaining the end of the cable connected to the equipment, and secondly imposing the direction of the cable at its connection with the connector (The orientation component may also further have, however, electrical functions like electrical shielding). For these purposes, the orientation component is preferably made in a high mechanical resistance material, such as a metal, like steel, or an industrial grade plastic. Its mechanical strength is especially useful for bending the shielded cable and imposing a direction to it.

Moreover, to fulfil the purpose of the invention, this mechanical strength is used to increase the reliability of the connection of the connector with the equipment. The mechanical connection function is integrated in the orientation component. For this reason, the connector body is released (or at least partially released) of its mechanical connection function. It allows possibly a further downsizing of the connector body, and a change of the material thereof, to optimize its dielectric properties. It also allows using a connector body as described in EP1622231, without changing or substantially changing this connector body, and provides a mechanically secured connection to the equipment.

Advantageously, at least one of the first and second fastening means comprises hooking means or clip-on means. Such fastening means have proven their efficiency for the connection. Clip-on fastening means are means that can be clipped on in a single movement, using the elasticity properties of the fastening means.

Advantageously, the connector body further comprises auxiliary fastening means, so that it can be fastened onto said equipment. These fastening means can be used in complement to the fastening due to the orientation component. These auxiliary fastening means may be useful, for instance, if the orientation of the cable with respect to the connector needs to be changed without disconnecting the cable. Thanks to the presence of the second fastening means on the orientation component, these auxiliary fastening means can have a minimized size because no important securing force is expected from them. They can simply comprise an elastic catch member, adapted to resiliently engage a retaining surface of the equipment and designed so as to automatically disengage said surface when a sufficient extraction force is applied on the connector body.

In that case, that is, when the connector comprises such fastening means contributing to its connection on the equipment, the functional splitting of the fastening function may be as follows: The fastening means of the connector comprise rails or slides, or any guiding means for realizing a sliding connection with the equipment; and on the other hand, the second fastening means of the orientation component are locking means, such as a retaining claw for instance, to prevent any disconnection of the equipment from the connector.

Moreover, advantageously, the connector further comprises release means, to release said connector from said equipment. Thanks to these release means, the connector can be removed and untied from the equipment. This situation can be necessary in different situations, for instance if the equipment has to be replaced after a breakdown.

In a preferred embodiment, said release means are provided on said orientation component especially so as to release the fastening provided by the second fastening means. Therefore, they can benefit from the mechanical properties, like the resilience or the elasticity, of the orientation component. However, more generally, the release means may be provided on the connector body or on the orientation component.

As shown on the following figures, advantageously the orientation component, including said release means, can be formed in a single part, and especially out of a simple sheet of metal. Therefore, advantageously, the orientation component is manufactured at low cost, and can be mounted very easily. A metal sheet is a material which combines high mechanical strength, combined with high elasticity properties. The elasticity properties make it possible to use self-positioning fastening means, such as hooks or clip-on means, as it will be seen hereafter.

PREFERRED MODE FOR CARRYING OUT THE INVENTION

Figure 1:
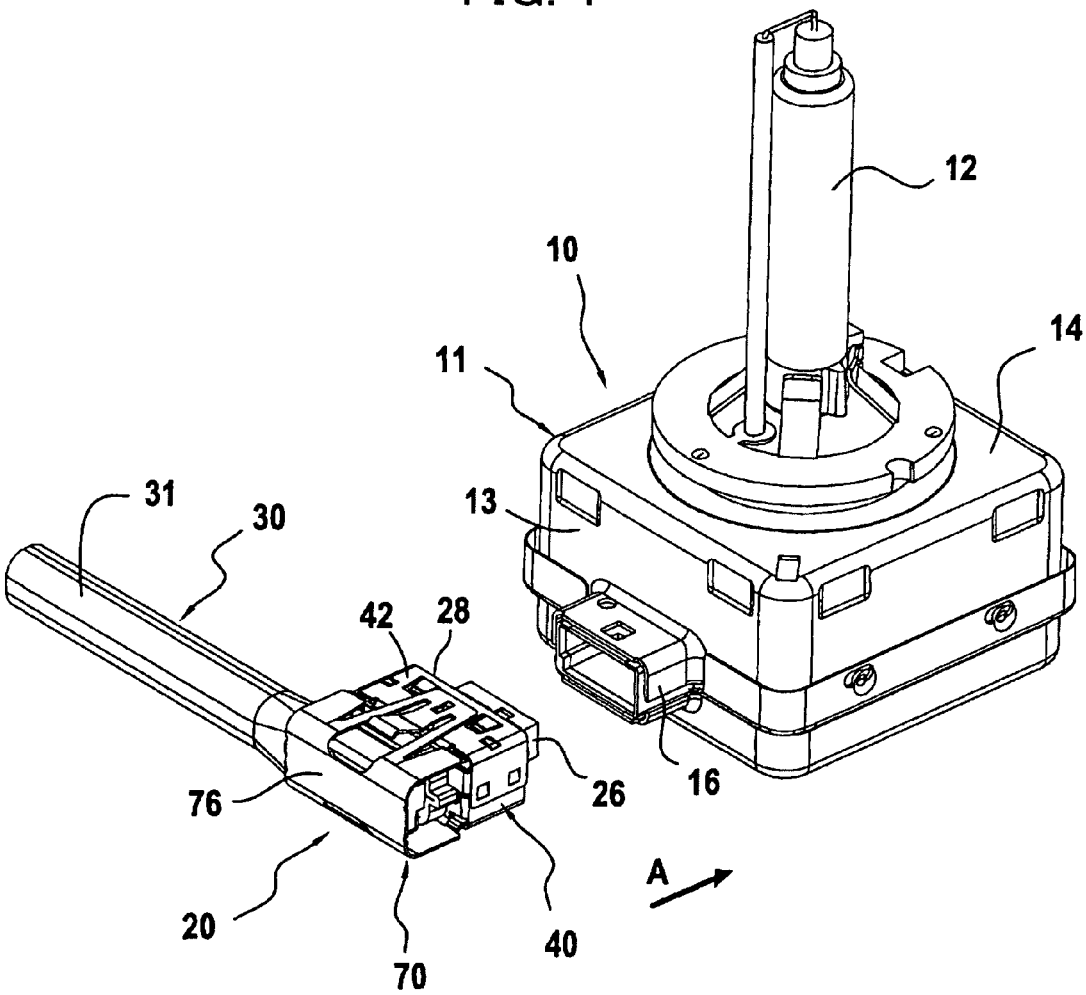
FIGS. 1 and 2 are perspective views depicting the end connector according to the invention, respectively about to be mounted and after having been mounted, on an equipment.
Figure 2:
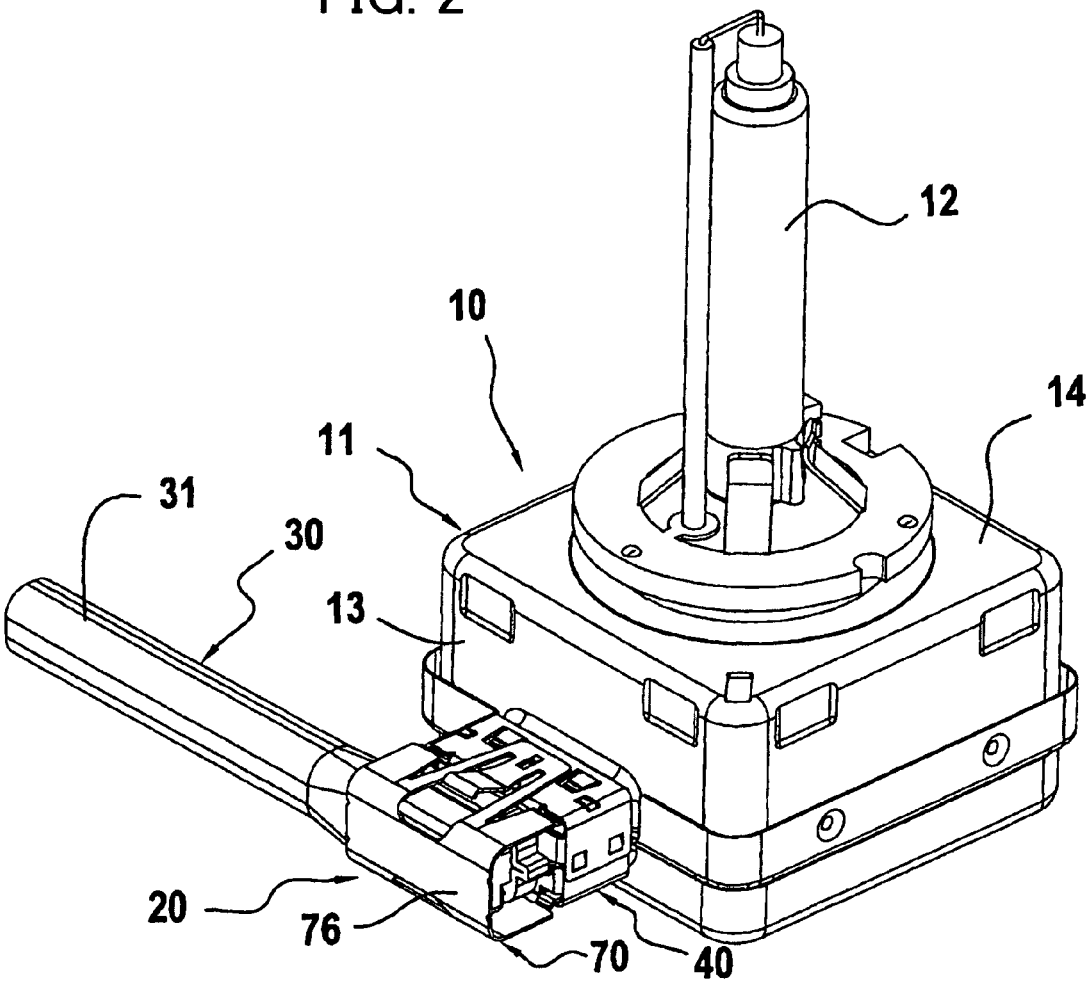
Figure 3:
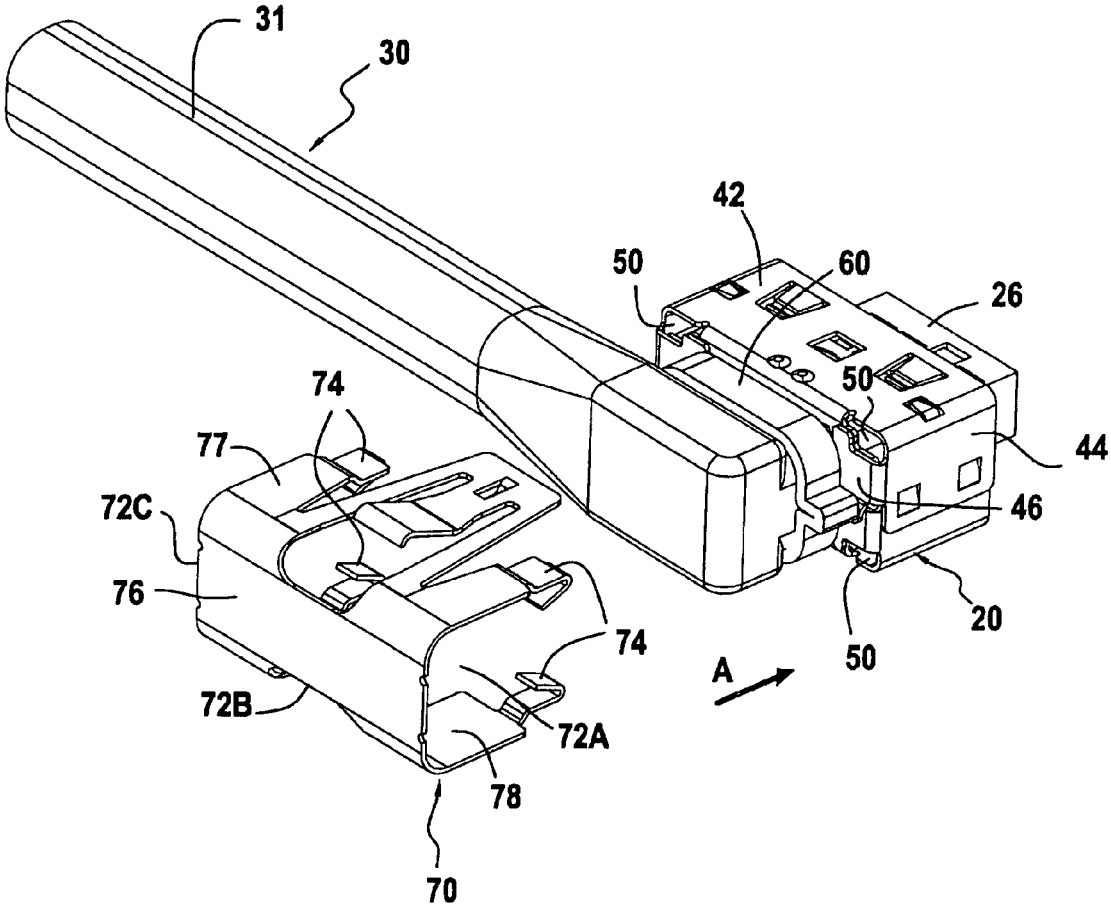
FIGS. 3 and 4 are perspective views depicting the mounting stages of the orientation component on the connector body.
Figure 4:
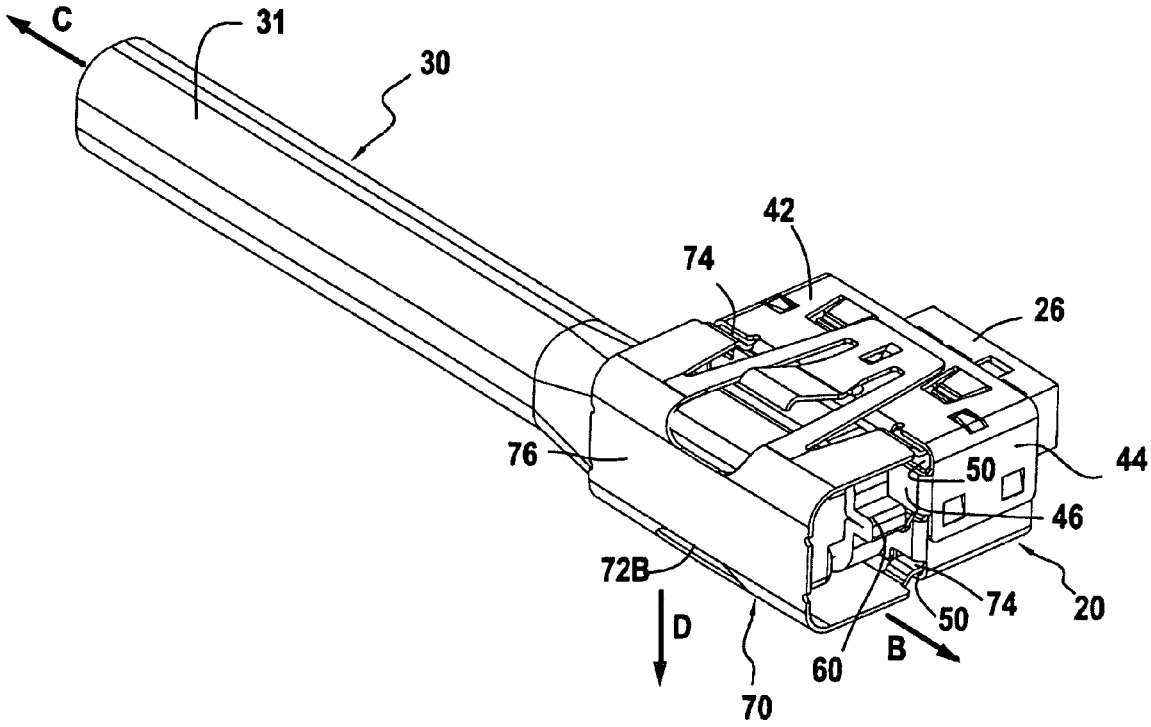
Figure 5:
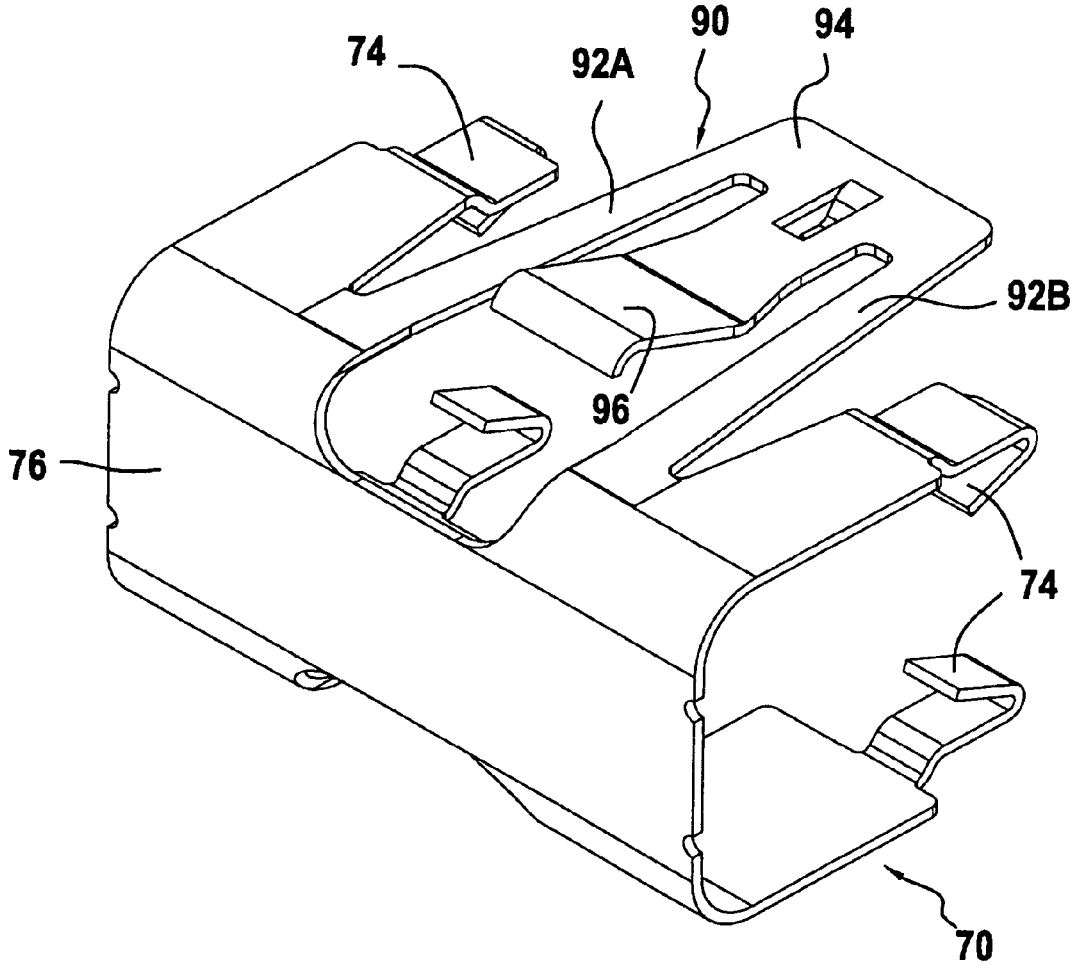
FIGS. 5 and 6 are perspective views depicting the orientation component structure.
Figure 6:
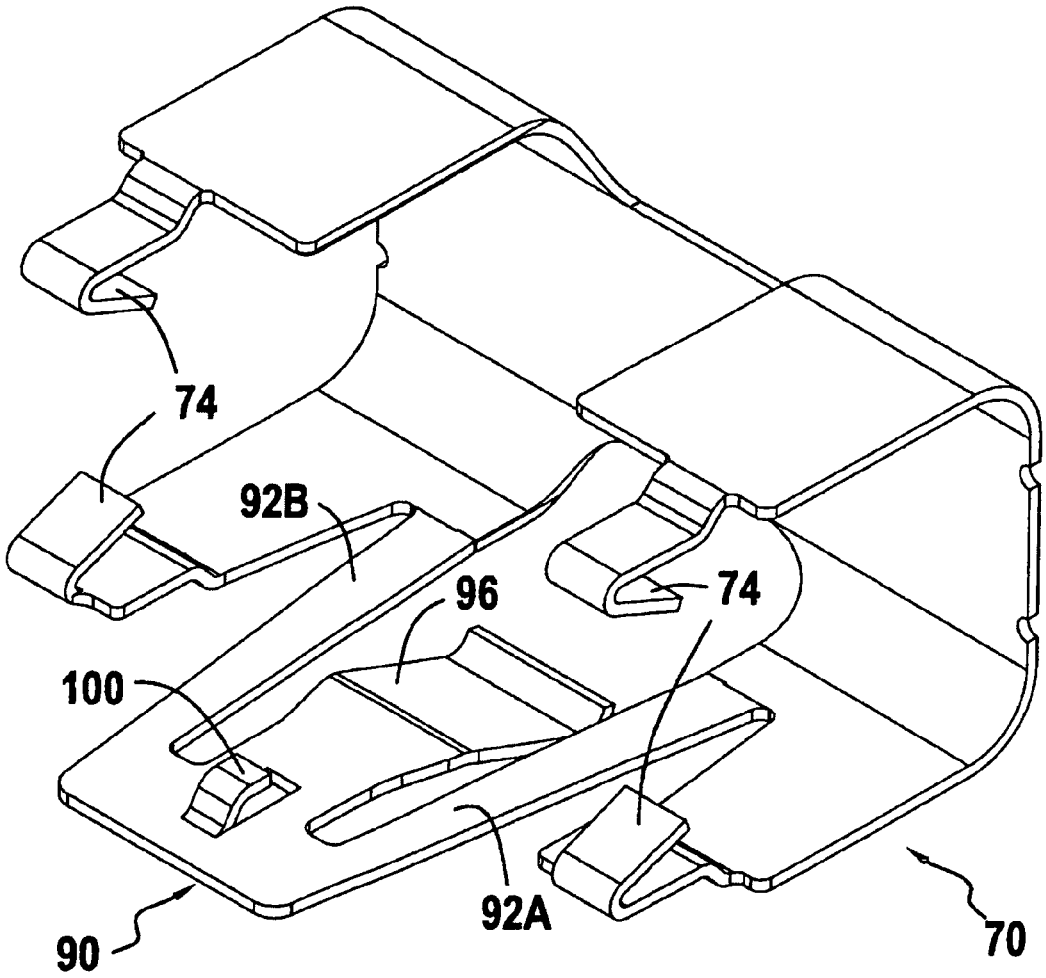
Figure 7:
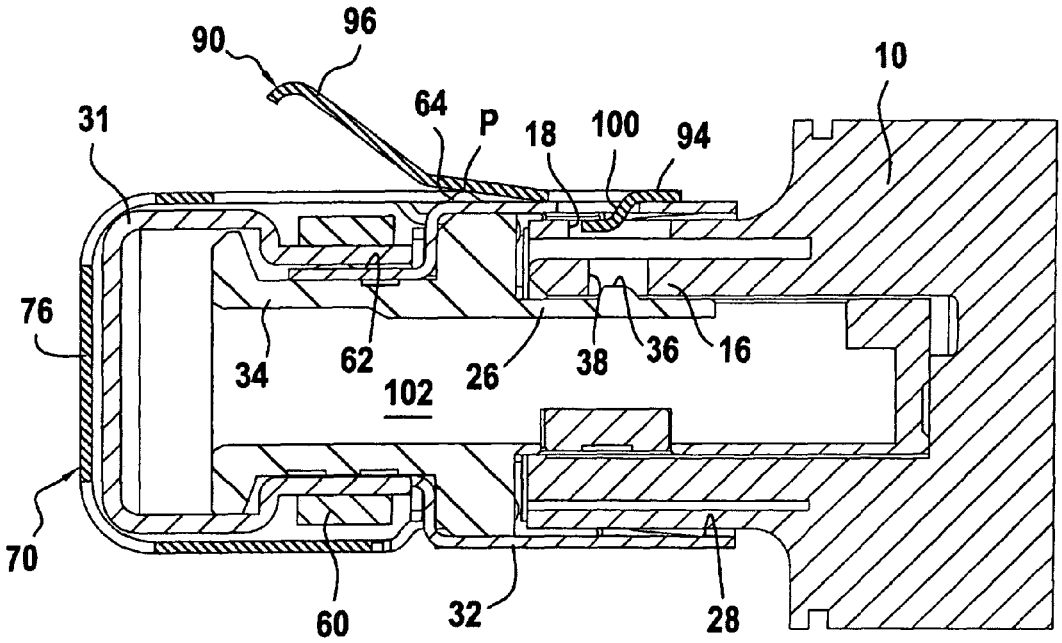
FIGS. 7 and 8 are cross-sectional views of the connector mounted on the equipment.
Figure 8:
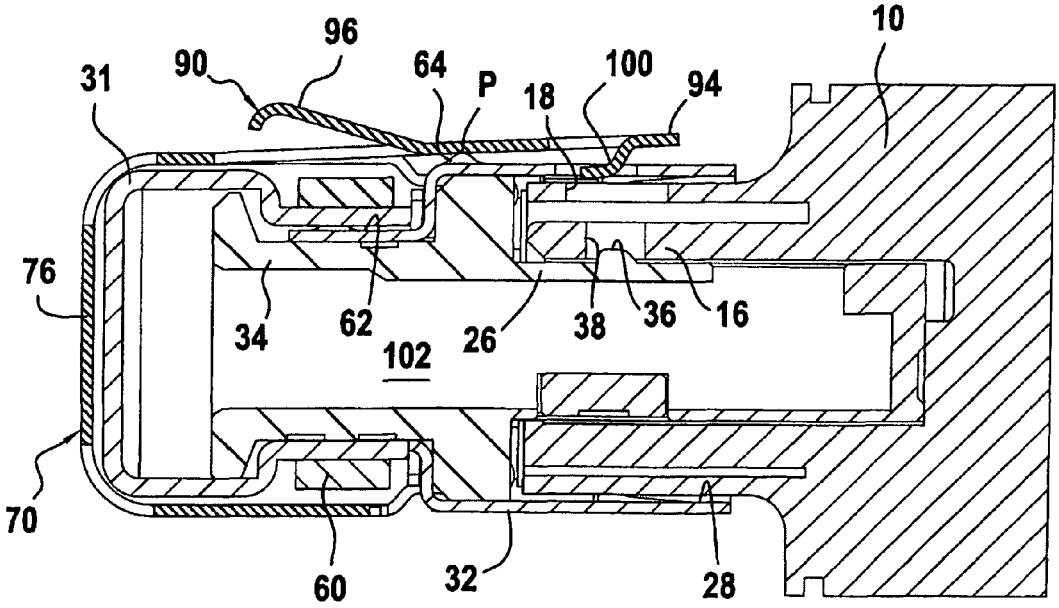

A preferred embodiment of the electrical connector will now be described by way of example with reference to the accompanying drawings, in which:

FIGS. 1 and 2 are perspective views depicting the end connector according to the invention, respectively about to be mounted and after having been mounted, on an equipment;

FIGS. 3 and 4 are perspective views depicting the mounting stages of the orientation component on the connector body;

FIGS. 5 and 6 are perspective views depicting the orientation component structure; and FIGS. 7 and 8, are cross-sectional views of the connector mounted on the equipment.

In relation with FIGS. 1 and 2, the mounting and the structure of an end connector according to the invention will now be described.

FIGS. 1 and 2 show a connector 20, mounted on an equipment 10. In this embodiment, the equipment 10 is a headlight, comprising a HID bulb 12. This bulb 12 is supported on a seat on a top face 14 of the housing 11.

The connector 20 is mainly composed of a connector body 40 on which an orientation component 70 is mounted. The connector 20 is connected to a shielded cable 30, that it connects to equipment 10. At its other end (not represented), the cable 30 is connected to an electronic card with a ballast, which delivers supply current to the headlight.

The connector body 40 comprises electrical connection means by which the cable 30 is electrically connected to the equipment 10, including the electrical connection of the electrical shielding braid 31 of the cable 30 to the outer metallic case of housing 11. The electrical connection means of the connector body 40, comprising electrical terminals, etc., are well known in the art and will not be further described here.

The connector body 40 further comprises fastening means for its positioning on the equipment. These fastening means are mainly guiding means, for guiding the sliding movement of the connector 20 relative to the equipment 10, upon connection thereof onto said equipment. These fastening means can somewhat contribute to the fastening of the connector 20 on the equipment 10, but they are not designed to resist extraction forces operated in a direction opposite to the connection direction. Usually, the fastening means of the connector body are of the male and female type, without hooks or fasteners. On the other hand, with the invention, the orientation component also comprises fastening means for its fastening on the equipment (described later). These fastening means of the orientation component are locking means, which only are able to reliably prevent the disconnection of the connector from the equipment. The fastening means of the connector body 40 comprise a projection 16 of the equipment 10, and corresponding receptacle 26 and opening (or guideway) 28 of the connector body 20.

The projection 16 of the equipment 10 is a male/female or hermaphroditic projection, located on a side face 13 of the housing 14. When connected, as shown on FIGS. 1 and 2, this projection 16 is set around receptacle 26 which houses the female terminals (not shown), and is guided in the guideway 28 on its outer side. Receptacle 26 houses electrical terminals (not shown of the figures) which are connected to corresponding electrical connection means of the equipment, for the electrical connection of the equipment 10 on the connector 20.

In this embodiment, the fastening means of the connector body are a hermaphroditic or male/female projection cooperating with a receptacle 26 and an opening 28 of the equipment. More generally, the connection means of the connector body 40 can be of any shapes which can engage and cooperate with corresponding shapes of the equipment, to contribute to the fastening of the connector 20 on the equipment 10, especially so as to guide the connector along a sliding mounting movement to mount it on the equipment.

With a connector such as the connector 20 of this embodiment, the connection of the cable 30 to the equipment 10 is very easy. Usually the connection of the connector 20 on the cable 30 is done in the cable factory, and the cable 30 arrives ready for mounting on the equipment 10, as shown on FIG. 1. However, the assembly sequence may be reversed.

The connection between the connector body 20, the orientation component 70 and the cable 30 will now be explained with reference to FIGS. 3 and 4.

The connector body has a generally rectangular shape, of which top face 42, side face 44, back face 46 can be seen on FIGS. 3 and 4. The aforementioned connection means of the connector 20 (receptacle 26) are located on the front face of the connection.

The internal structure of the connector body is well known in the art and will, not be detailed here. It suffices to indicate that it comprises an inner housing 34, which is a plastic moulded component, supporting an outer shield 32 (see FIGS. 7, 8).

The shield provides a continuous electrical shielding against electromagnetic interferences between the electrical shield of the cable (braid 31) and the corresponding electrical shield of the equipment 10.

The cable 30 is connected to the connector body 20 on the back face 46 thereof. Although it is shown on the figures as having a rather square shape near its junction with the connector 20, it usually has a substantially circular sections, corresponding to the shape of the cable braid 31. The cable 30 is gripped by a crimped collar 60, which tightly holds the braid 31 on a neck 62 of the shield protruding on the back face 46 of the connector 20.

The braid 31, and more generally the whole cable 30 are flexible, so that the cable end can be bent with a very small radius of curvature. Thanks to this feature, the orientation component does not have to be large. Its back face 76 can be set at little distance of the connector body, little more than the diameter of the cable 30.

The orientation component is made of a bent metal sheet. It is formed so as to comprise guiding means to set the direction of the cable at its junction with the connector. These guiding means comprise three or four apertures 72A, 72B, 72C through which the shielded cable 30 can pass, so as to set the direction of the cable in one out of three or four predetermined directions B, C, D (FIG. 4). A fourth opening may be provided through the back wall 76, in order to connect a cable along the connection direction (arrow A).

The cable is adapted to pass through any of these openings or apertures 72A, 72B, 72C whereby it is directed in the appropriate direction at its junction with the connector. Hence, the length of the cable can be minimized, and the route of the cable leading to the electronic card can be optimized.

As it has mechanical functions, the orientation component must be made preferably in a sturdy, resilient material. It can be made of moulded plastic, but preferably, it will be made, as shown, out of a bent metal sheet, and manufactured by stamping, bending and cutting.

The material of the orientation component should also have adequate elasticity properties. Indeed, further to its orientation function, the orientation component realises its main function of fastening thanks to first and second fastening means. In the example shown, the first fastening means are formed by hooking projections 74 retained in corresponding holes 50 of the connector body, and the second fastening means are formed by a retaining portion 100 designed to be retained in a recess or hole 18 of the equipment.

Advantageously, these fastening means are self-locking upon connection, which means that they can be deformed during a short instant at mounting, and then resume their rest (or natural) shape as soon as they have entered into the hole in which they are set, thanks to their resiliency.

More precisely, the first fastening means that secure the connection of the orientation component to the connector body comprise four hooks 74, two of them being on two angles of the top face 77 of the orientation component, extending towards the connector, the other two being at symmetrical positions, on the bottom face 78. The connector body has four windows or holes 50, located at the four corners of the rear face of the connector body. These windows have sizes that enable the hooks 74 to penetrate into them and they open against the back face 46 of the connector body which acts as retaining means for retaining the hooks 74 in said windows 50. When it is fastened on the connector body 20, the orientation component is pushed, usually manually, on the connector body in a connection direction corresponding to arrow A (FIG. 3). During this movement, the hooks 74 get clipped in windows 50 provided in the connector body 20, whereby the orientation component is fastened and locked to connector body 20. The hooks 74 prevent any withdrawal of the orientation component operated without a tool specially designed to un-hook the hooks 74.

It must also be noted that the hooks 74 not only have an anti-withdrawal function, but also a real positioning function. Indeed, when they are engaged in windows 50, their ends also contact inner surfaces of the shield 32 (on top and bottom faces). Therefore, because of the location of the hooks on four angles of the orientation component (seen in connection direction), the hooks secure the positioning of the orientation component on the connector body so that no relative rotation around connection axis can take place.

Moreover, when the orientation component is set in position, with hooks 74 locked in the windows 50, the back wall 76 of the orientation component contacts the cable 30, preventing or further movement of the orientation component in the connection direction.

The second fastening means serve to mechanically lock the orientation component to the equipment 10. Advantageously, the second fastening means comprise a retaining portion (claw 100) adapted to engage and lock the equipment 10. For the release of this retaining portion, a lever (96) is provided, which can be pushed so that said retaining portion moves away from a retaining portion engagement direction whereby the connector is unfastened.

Advantageously, the retaining portion is formed in a tongue—like extension 90, and extends in a retaining portion engagement direction skewed or transverse with respect to a connection direction (arrow A).

The tongue 90 extends from the main portion of the orientation component 70 towards the equipment 10 along an appropriate distance so as to contact a corresponding grip portion (hole 18) of the equipment on which the retaining portion can be locked. For the locking, the retaining portion is moved in a direction which must be different from the connection direction, that is, skewed or transverse with respect to the connection direction. By such a move, the retaining portion is locked by the corresponding surface or portion of the equipment, the inner surface of hole 18 in this embodiment (FIGS. 7, 8).

In this embodiment, the retaining portion is a claw 100 as best shown on FIGS. 5, 6, which cooperates and is locked in the hole 18 in the mounted position of the connector. This claw is cut in the sheet in which the orientation component is formed, and bent (arrow D) so as to project on an inner face of the tongue 90.

Naturally, the retaining portion might also be a hole (not shown), cooperating with a corresponding bump or claw of the equipment. In that case, the hole would also have to be moved in a skewed or transverse direction to engage and retain the bump or claw of the equipment, and the hole constituting the retaining portion would need to have some extension in a direction skewed or transverse with respect to the connection direction.

The tongue 90 extends from a top face 78 of the orientation component, in the connection direction (arrow A) when the orientation component is mounted.

The tongue 90 comprises two substantially parallel arms 92A, 92B. A distal end of the arms (the end on equipment side) are connected to a small platform 94 that forms a bridge between the arms 92A and 92B. The arms 92A, 92B, the platform 94 are formed in the same plane, and are placed in mounted position above the top face 42 of the connector body.

The retaining portion is formed in a central portion of the platform 94. As best shown on FIGS. 7, 8, claw 100 penetrates in an opening 18 of equipment 10 for fastening the orientation component (as well as the connector body to which the orientation component is fastened) to the equipment 10.

FIGS. 7 and 8 show a cross section of the connector, when receptacleged on the equipment 10. The central part of the connector, with the electrical connections is not shown and left in blank (numeral 102).

The equipment 10 is presented on the right of the drawing, with extension 16 thereof protruding leftward. This extension 16 is gripped by an electric shield 32 in its guideway 28. The connector housing 34 is enclosed inside the shield 32. The connector housing 34 and the shield 32 are the main components of the connector body 40.

The receptacle 26 of the connector body 40 comprises a bump or protuberance 36, on its upper face. The extension 16 of the equipment has a corresponding hole 38, to receive the bump, fastening thereby the connector body on the equipment.

The bump 36 and the hole 38 are part of the fastening means of the connector on the equipment. When an extraction force is applied to the connector to disconnect it, the bump 36 is pushed by the inner wall of hole 38 and elastically moves downward so as to let bump 36 get off hole 38.

Moreover, as the bump 36 is a small plastic part, it has been observed that it tends to wear out over the lifetime of the vehicle. The vibrations of the vehicle cause reciprocating movements of the bump relative to the hole, which end by the bump being erased, especially as temperatures may be very high in this area. Because of that phenomenon, after a while, the fastening of the connector is not secured anymore by bump 36.

For this reason, more study fastening means are provided in this connector, thanks to the dedicated fastening and orientation component 70.

The fastening (and orientation) component 70 is presented on FIGS. 7 and 8 with dense hatching.

As shown, it is arranged so as to form a bridge that caps at least a rear portion of the connector body 40, when seen in the cross-sectional direction. Seen in a cross-section in a transverse plane comprising the connection direction, the orientation component is substantially U-shaped.

On the left, the wall 76 acts as a guiding means to set the orientation of the cable. From the cable, only the braid 31 thereof is shown on the figures. The braid 31 is secured on an end neck portion 62 of the shield 32 by a collar 60.

As mentioned before, the claw 100 of tongue 90 is hooked in the hole 18 of the extension 16 for fastening the orientation component to the equipment.

At rest, the shape of the orientation component 70 is so that the tongue 90 tends to lean against top face 42 of the shield. In that position, the claw 100 is positioned inside the hole 18 and firmly locks the connector on the equipment.

However, as mentioned before, it is sometimes necessary to disconnect the connector from the equipment. For that purpose, the connector further comprises release means, by which it can be released from the connector. These release means can be part of the orientation component, or of the connector body, or of both.

In this embodiment, the release means comprise a lever 96, which can be pushed so that the claw 100 acting as retaining portion moves away from the retaining portion engagement direction whereby the connector 20 is unfastened.

More precisely, after claw 100 is unlocked, the connector is disconnected by a slide backward, to disengage extension 16 of the equipment from receptacle 26 and opening 28. Advantageously, no tool is needed for this operation: Advantageously the connector can be fastened and unfastened by hand on the equipment.

Advantageously, the lever 96 is arranged to react against a reacting part 64 of one of the connector or of the equipment, so that when said lever 96 is pushed, the lever contacts said reacting part, and makes a pivotal movement which frees said retaining portion.

Advantageously, the reacting part comprises an embossment or bump 64 formed on the upper face of the connector as shown on FIGS. 7 and 8. The pivotal movement therefore takes place around point P. Therefore, when the lever 96 is pressed downward (generally manually), the platform 94 and the claw 100 are raised upward, whereby the claw is freed from the hole 18, as shown on FIG. 8.

Advantageously, the claw in this embodiment is in metal, whereby there is no chance that it could wear off or be erased due to the vibrations of the vehicle. Therefore, the fastening function of the claw 100 can last for a long time. Besides, the pulling strain exerted by the cable 30 on the connector, is received and transmitted by the (metallic) orientation component, instead of being transmitted through the connector body inner housing 34, which is a plastic moulded shape, as seen in many prior art embodiments. Therefore, the risk of breaking or damaging the inner housing 34, and thereby provoking an electrical breakdown, is reduced.

Lastly, it must be noted that although the shown embodiment comprises only one tongue or extension 90 to support one retaining portion 100, two or more several extensions 90 with corresponding retaining portions may be provided.

The orientation component may further be designed to include rails so as to slide on the equipment, which would reduce even further the need of a positioning function in connector body 40.

The invention claimed is:

1. End connector for connecting a shielded cable to an equipment on which it is to be connected, comprising:

a connector body provided to receive the shielded end of said shielded cable; and an orientation component having first fastening means for the fastening thereof onto said connector body and cable guiding means to set the orientation of the cable at the connection thereof with the connector body, wherein the orientation component further comprises second fastening means for the fastening thereof onto said equipment and wherein the guiding means comprise three or four apertures through which the shielded cable can pass, so as to set the direction of the cable in one out of three or four predetermined directions.

2. End connector according to claim 1, wherein at least one of the first and second fastening means comprises hooking means.

3. End connector according to claim 1, wherein at least one of the first and second fastening means comprises clip-on fastening means.

4. End connector according to claim 1, wherein the connector further comprises release means, to release said connector from said equipment.

5. End connector according to claim 4, wherein said release means are provided on said orientation component.

6. End connector according to claim 4, wherein said release means comprise a retaining portion adapted to engage the equipment, and a lever which can be pushed so that said retaining portion moves away from a retaining portion engagement direction whereby said connector is unfastened.

7. End connector according to claim 6, wherein said retaining portion is formed in a tongue-like extension, and extends in a retaining portion engagement direction skewed or transverse with respect to a connection direction.

8. End connector according to claim 6, wherein said lever is arranged to react against a reacting part of one of the connector or of the equipment, so that when said lever is pushed, the lever contacts said reacting part, and makes a pivotal movement which frees said retaining portion.

9. End connector according to claim 8, wherein said reaction part comprises an embossment.

10. End connector according to claim 1, wherein the orientation component is made of a single sheet of metal.

11. End connector according to claim 1, wherein the orientation component caps the rear portion of at least a rear portion of the connector body.

12. End connector according to claim 1, wherein the connector body further comprises fastening means, so that it can be fastened onto said equipment.

13. End connector according to claim 1, wherein the connector can be fastened and unfastened by hand on the equipment.

* * * * *